US012655844B2

(12) United States Patent
Lee

(10) Patent No.: US 12,655,844 B2
(45) Date of Patent: Jun. 16, 2026

(54) PUMP

(71) Applicant: LG INNOTEK CO., LTD., Seoul (KR)

(72) Inventor: Moon Jae Lee, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 6 days.

(21) Appl. No.: 18/843,612

(22) PCT Filed: Mar. 27, 2023

(86) PCT No.: PCT/KR2023/003999
§ 371 (c)(1),
(2) Date: Sep. 3, 2024

(87) PCT Pub. No.: WO2023/210977
PCT Pub. Date: Nov. 2, 2023

(65) Prior Publication Data

US 2025/0172140 A1 May 29, 2025

(30) Foreign Application Priority Data

Apr. 28, 2022 (KR) ..... 10-2022-0052917

(51) Int. Cl.
*F04C 15/00* (2006.01)
*F04C 2/08* (2006.01)

(52) U.S. Cl.
CPC ..... *F04C 15/0065* (2013.01); *F04C 2/084* (2013.01); *F04C 2240/20* (2013.01); *F04C 2240/50* (2013.01); *F04C 2240/60* (2013.01)

(58) Field of Classification Search
CPC ... F04C 15/0069; F04C 2/101; F04C 2240/60
See application file for complete search history.

(56) References Cited

U.S. PATENT DOCUMENTS

| | | | | |
|---|---|---|---|---|
| 2005/0220653 | A1 | 10/2005 | Shafer et al. | |
| 2011/0229361 | A1 | 9/2011 | Kuroda et al. | |
| 2018/0313352 | A1 | 11/2018 | Sandore et al. | |
| 2019/0249661 | A1 * | 8/2019 | Wang | F04C 2/086 |
| 2020/0088180 | A1 | 3/2020 | Kim et al. | |

FOREIGN PATENT DOCUMENTS

| | | | | |
|---|---|---|---|---|
| JP | 6-41755 | B2 | 6/1994 | |
| JP | 3972465 | B2 | 9/2007 | |
| JP | 2012-26294 | A | 2/2012 | |
| JP | 2023000097 | A * | 1/2023 | H02K 5/225 |
| KR | 10-2020-0120897 | A | 10/2020 | |

OTHER PUBLICATIONS

JP-2023000097-A English Translation (Year: 2023).*

* cited by examiner

*Primary Examiner* — Anthony Ayala Delgado
(74) *Attorney, Agent, or Firm* — Birch, Stewart, Kolasch & Birch, LLP

(57) ABSTRACT

A pump comprises: a housing; a stator disposed in the housing; an outer gear disposed in the stator, an inner gear disposed in the outer gear, a shaft disposed at the center of the inner gear; and a bearing coupled to one end of the shaft, wherein the shaft comprises a first region coupled to the inner gear and a second region coupled to the bearing, and the center of the first region and the center of the second region are different from each other.

19 Claims, 6 Drawing Sheets

PUMP

CROSS REFERENCE TO RELATED APPLICATIONS

This application is the National Phase of PCT International Application No. PCT/KR2023/003999, filed on Mar. 27, 2023, which claims priority under 35 U.S.C. 119 (a) to Patent Application No. 10-2022-0052917, filed in the Republic of Korea on Apr. 28, 2022, all of these applications being hereby expressly incorporated by reference into the present application.

TECHNICAL FIELD

The present embodiment relates to a pump.

BACKGROUND ART

The pump includes a motor area that generates rotational driving force and a pump area that generates hydraulic pressure. Therefore, since the motor area and the pump area within the pump are separated from each other, there is a problem in that the number of parts and the overall product are increased.

In general, the EOP may include a housing, a stator being disposed within the housing, and an outer gear and an inner gear being disposed inside the stator. Among these, the arrangement area of the outer gear is set by a can being disposed in between with the stator, and the arrangement area of the inner gear is set by a cover being coupled to the housing.

According to the above structure, the arrangement area of the outer gear and the inner gear is set by different parts, so there is a problem in that an accumulated tolerance occurs between a plurality of parts inside the pump.

In addition, since the EOP according to the prior art does not have a means to support the axial load being applied to the external rotor, as the operating pressure inside the pump increases, so there is a problem in that the rotational stability of the external rotor or internal rotor is degraded due to the force being applied at the outlet of the pump. In particular, when high pressure of 3 bar or more is generated, friction with the housing occurs due to the axial misalignment of the external rotor, which is a factor that hinders the performance of the pump.

DETAILED DESCRIPTION OF THE INVENTION

Technical Subject

The present embodiment is intended to provide a pump that can enhance production efficiency through the enhancement of assemblability by improving the structure.

In addition, it is intended to provide a pump that can manage the amount of eccentricity by minimizing the tolerance between the outer gear and the inner gear.

In addition, the present invention is intended to provide a pump that can evenly distribute the load caused by hydraulic pressure and improve the decrease in hydraulic pressure inside the pump.

In addition, the present invention is intended to provide a pump that can be miniaturized through size reduction.

Technical Solution

A pump of the present embodiment comprises: a housing; a stator being disposed inside the housing; an outer gear being disposed inside the stator; an inner gear being disposed inside the outer gear; a shaft being disposed at the center of the inner gear; and a bearing being coupled to one end of the shaft, wherein the shaft comprises a first region being coupled to the inner gear and a second region being coupled to the bearing, and wherein the center of the first region and the center of the second region are different from each other.

The cross-sectional area of the first region may be larger than the cross-sectional area of the second region.

The outer gear and the inner gear may rotate eccentrically.

The axial length of the first region may correspond to the axial length of the inner gear and the outer gear.

With respect to the axial direction, the length of the second region may be smaller than the length of the first region.

The length of the second region may be equal to or less than ½ of the length of the first region.

The center of the first region may correspond to the rotation center of the inner gear.

The center of the second region may correspond to the center of rotation of the outer gear.

The distance between the center of the first region and the center of the second region with respect to the radial direction may be 0.02 mm or less.

The inner gear may include a first hole to which the first region is coupled, and the bearing may include a second hole to which the second region is coupled.

Advantageous Effects

Through the present embodiment, the eccentric amount between the outer gear and the inner gear can be set through the eccentric amount between the plurality of regions of the shaft, so there is an advantage that the precision of assembly between the plurality of parts can be enhanced.

In addition, since rotation components including bearings can be aligned through a single shaft, there is an advantage in that the overall size of the product can be reduced with respect to the axial direction.

In addition, since the inner gear, outer gear, and shaft are coupled to one another simply by assembling the shaft and the inner gear, and the shaft and the outer gear, there is an advantage of improving production efficiency by reducing the assembly time.

BEST MODE

Hereinafter, preferred embodiments of the present invention will be described in detail with reference to the accompanying drawings.

However, the technical idea of the present invention is not limited to some embodiments to be described, but may be implemented in various forms, and within the scope of the technical idea of the present invention, one or more of the constituent elements may be selectively combined or substituted between embodiments.

In addition, the terms (including technical and scientific terms) used in the embodiments of the present invention, unless explicitly defined and described, can be interpreted as a meaning that can be generally understood by a person skilled in the art, and commonly used terms such as terms defined in the dictionary may be interpreted in consideration of the meaning of the context of the related technology.

In addition, terms used in the present specification are for describing embodiments and are not intended to limit the present invention. In the present specification, the singular form may include the plural form unless specifically stated in the phrase, and when described as "at least one (or more than one) of A and B and C", it may include one or more of all combinations that can be combined with A, B, and C.

In addition, in describing the components of the embodiment of the present invention, terms such as first, second, A, B, (a), and (b) may be used.

These terms are merely intended to distinguish the components from other components, and the terms do not limit the nature, order or sequence of the components.

And, when a component is described as being 'connected', 'coupled' or 'interconnected' to another component, the component is not only directly connected, coupled or interconnected to the other component, but may also include cases of being 'connected', 'coupled', or 'interconnected' due that another component between that other components.

In addition, when described as being formed or arranged in "on (above)" or "below (under)" of each component, "on (above)" or "below (under)" means that it includes not only the case where the two components are directly in contact with, but also the case where one or more other components are formed or arranged between the two components. In addition, when expressed as "on (above)" or "below (under)", the meaning of not only an upward direction but also a downward direction based on one component may be included.

Figure 2:
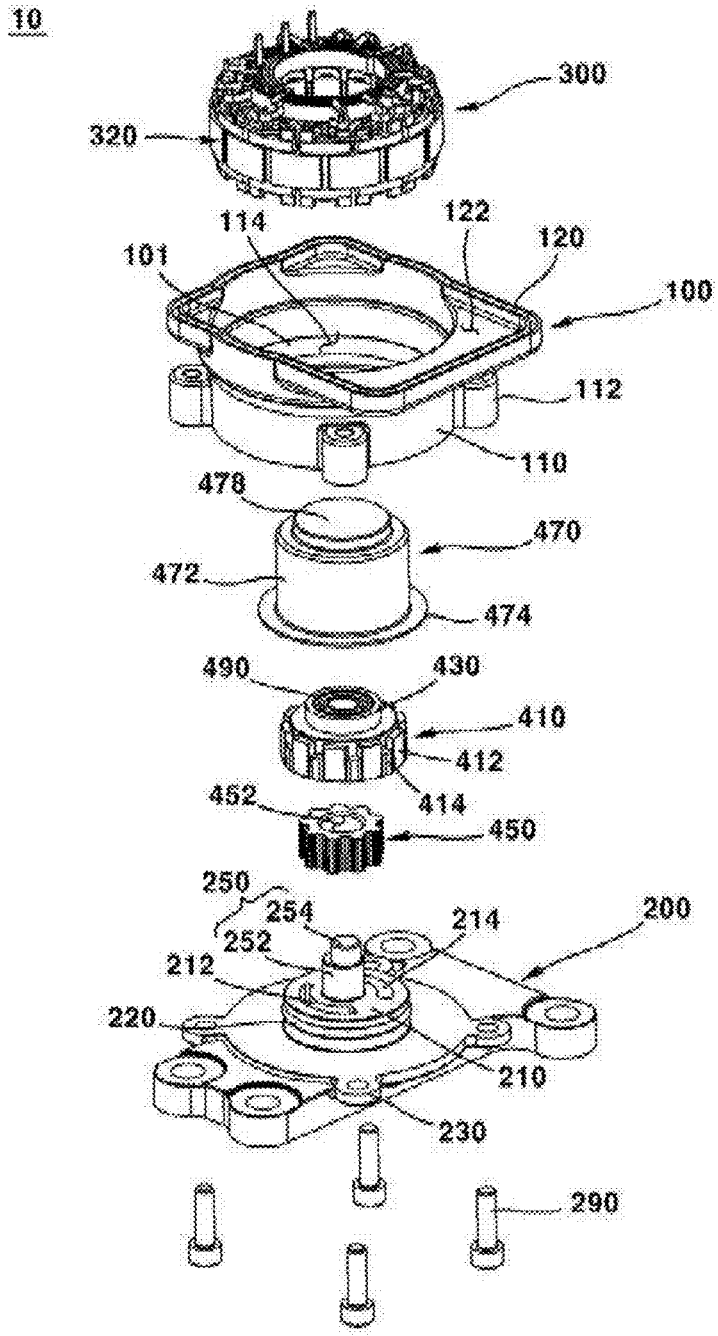
FIG. 2 is an exploded perspective view of a pump according to an embodiment of the present invention.

The 'axial direction' used hereinafter is defined as the direction forming the center of rotation of the inner gear or outer gear. The 'axial direction' may be the direction in which components disassembled based on FIG. 2 are coupled.

The 'radial direction' used hereinafter is defined as the direction perpendicular to the 'axial direction' described above. The 'radial direction' may be defined as the protruding direction of the first lobe from the inner surface of the outer gear and the protruding direction of the second lobe from the inner surface of the inner gear.

The 'circumferential direction' used hereinafter can be defined as a circumferential direction of any one among the stator, outer gear, and inner gear, or a circumferential direction of the region forming a virtual concentric circle with a circumferential direction among any one among the stator, outer gear, and inner.

Figure 1:
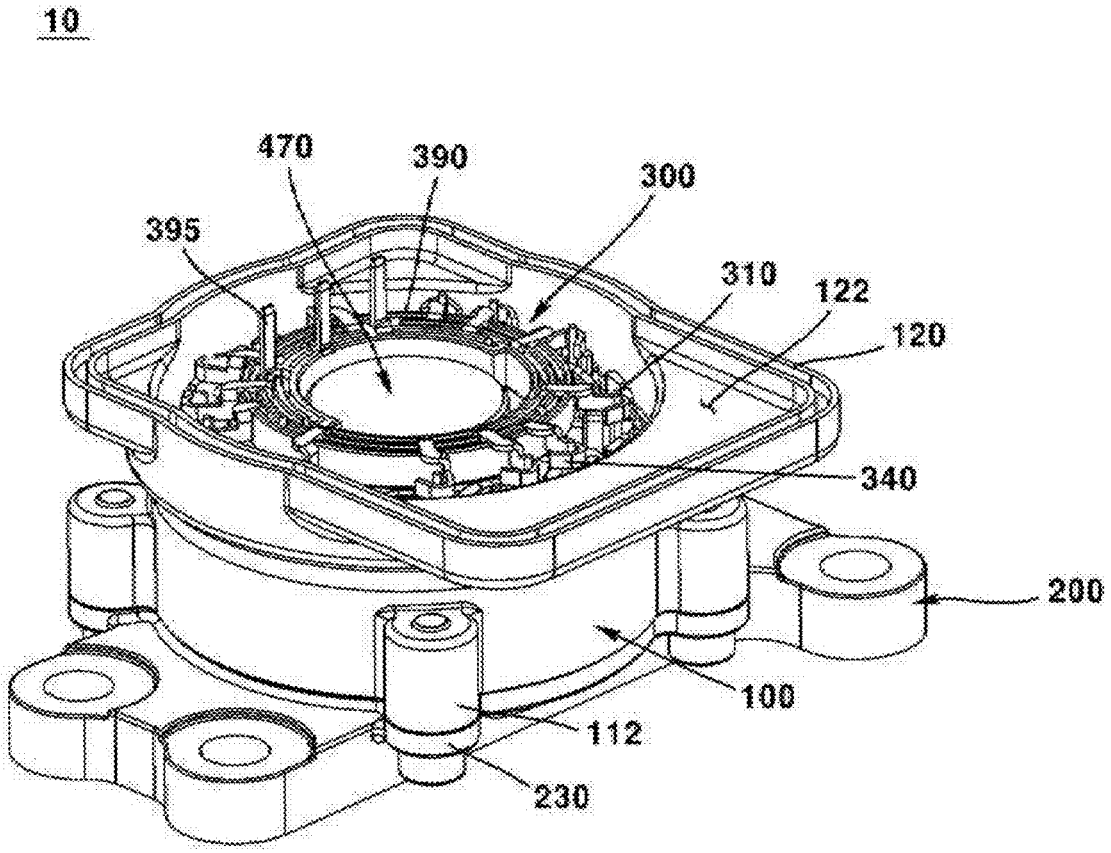
FIG. 1 is a perspective view of a pump according to an embodiment of the present invention.
Figure 3:
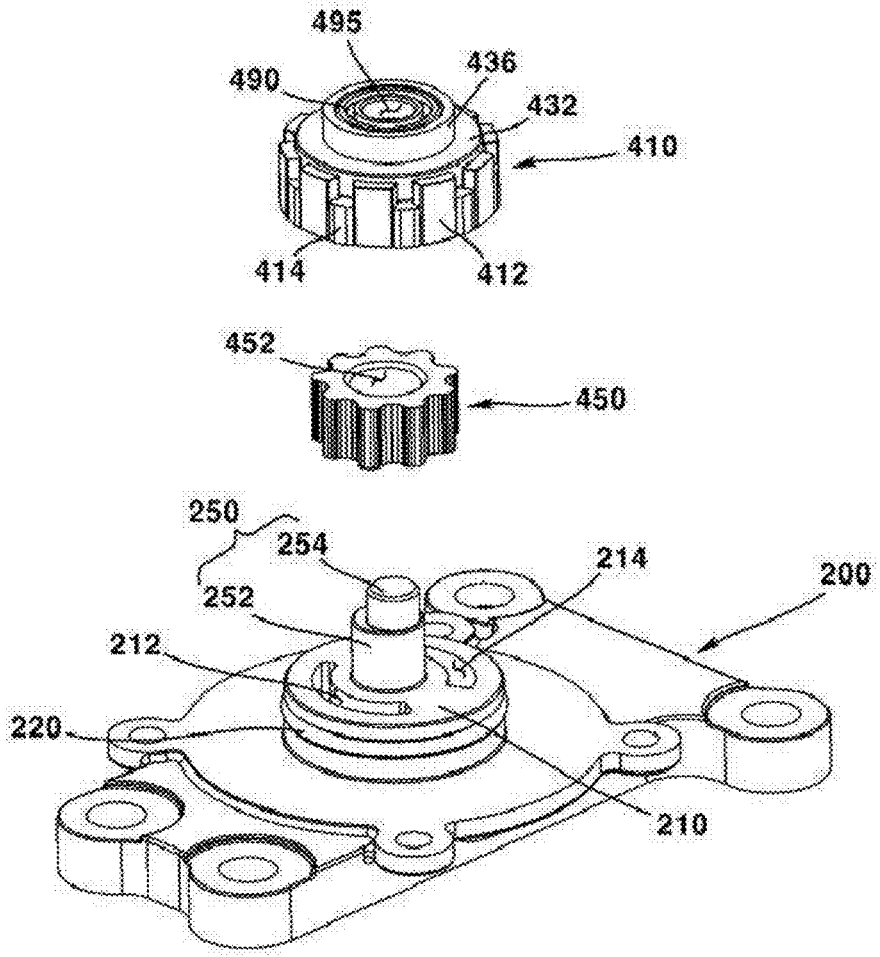
FIG. 3 is an exploded perspective view of an outer gear, an inner gear, and a cover according to an embodiment of the present invention.
Figure 4:
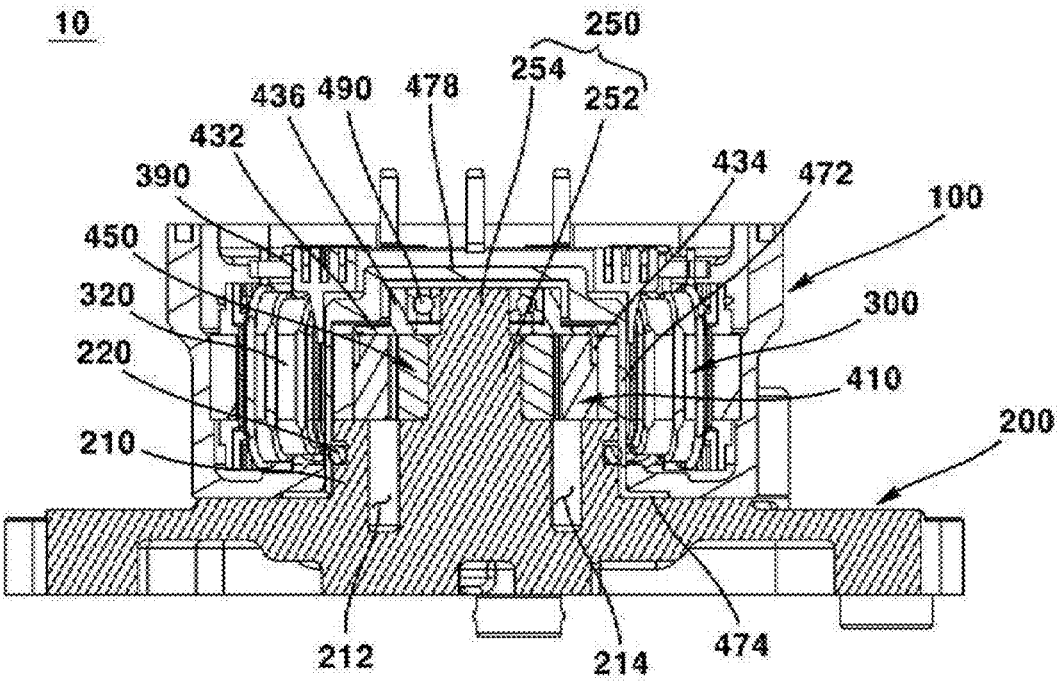
FIG. 4 is a cross-sectional view of a pump according to an embodiment of the present invention.
Figure 5:
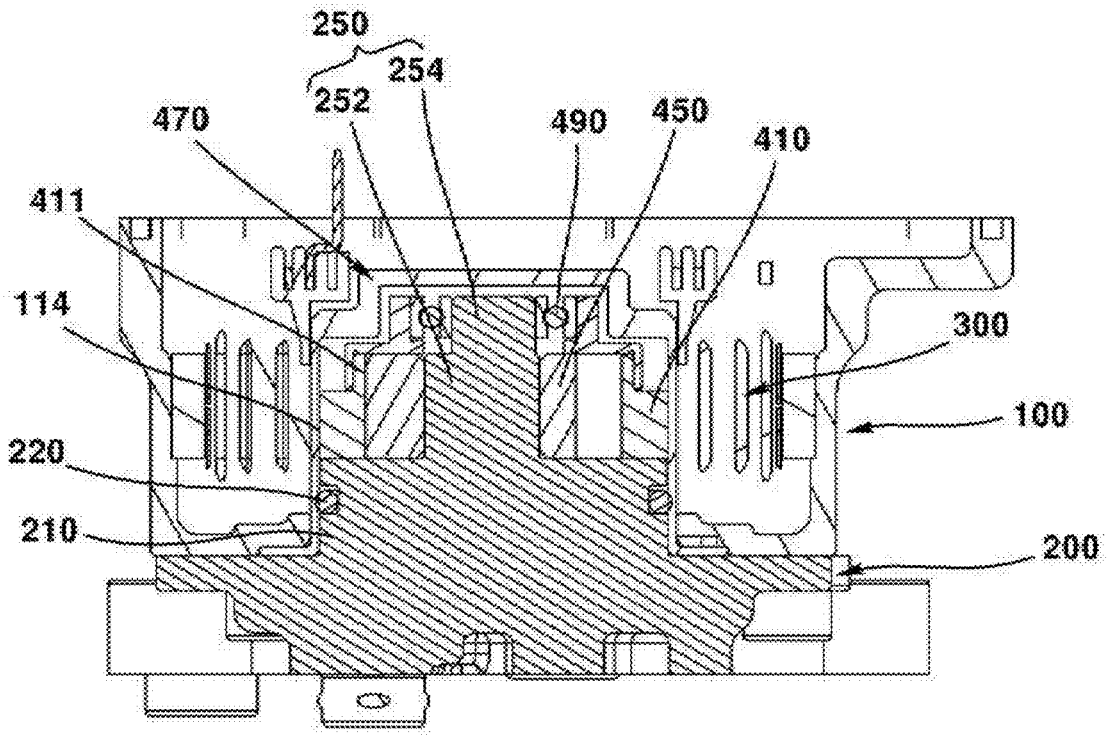
FIG. 5 is a view illustrating FIG. 4 from another angle.
Figure 6:
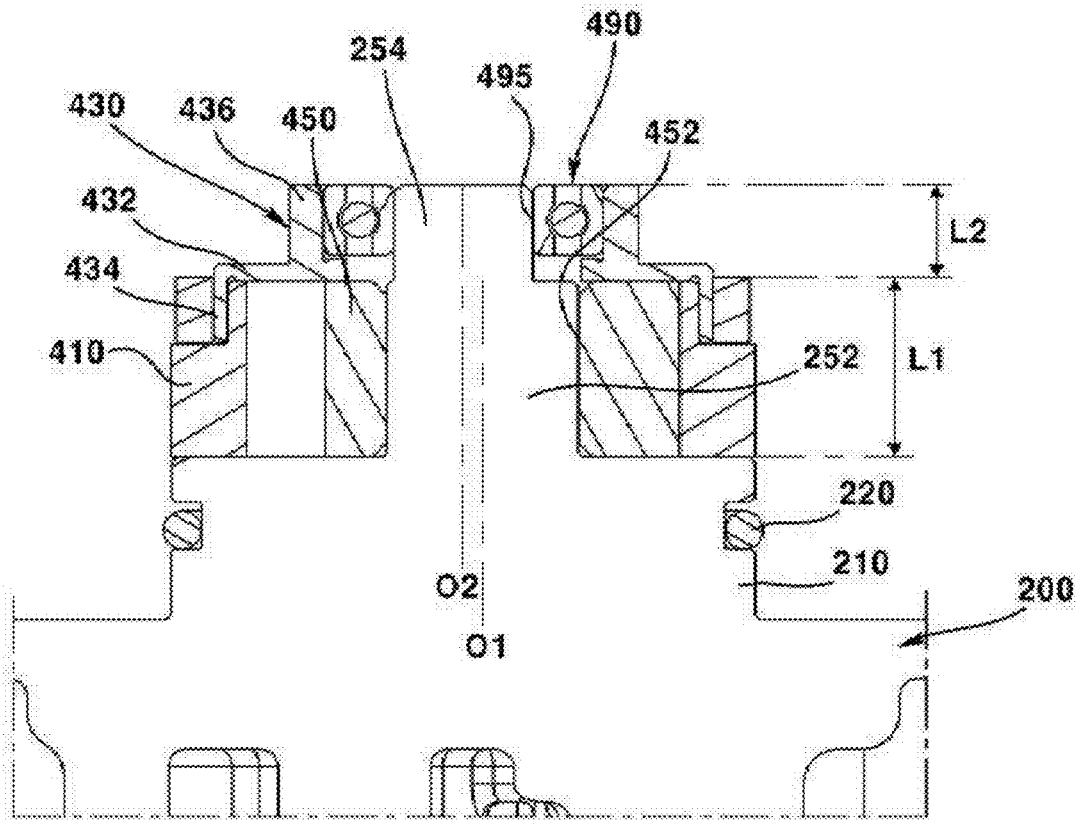
FIG. 6 is a cross-sectional view illustrating a coupled structure of a cover, an outer gear, an inner gear, and a bearing according to an embodiment of the present invention.

FIG. 1 is a perspective view of a pump according to an embodiment of the present invention; FIG. 2 is an exploded perspective view of a pump according to an embodiment of the present invention; FIG. 3 is an exploded perspective view of an outer gear, an inner gear, and a cover according to an embodiment of the present invention; FIG. 4 is a cross-sectional view of a pump according to an embodiment of the present invention; FIG. 5 is a view illustrating FIG. 4 from another angle; and FIG. 6 is a cross-sectional view illustrating a coupled structure of a cover, an outer gear, an inner gear, and a bearing according to an embodiment of the present invention.

Referring to FIGS. 1 to 6, an external shape of the pump 10 according to an embodiment of the present invention may be formed by coupling the housing 100 and the cover 200. The cover 200 may be coupled to a lower surface of the housing 100. The housing 100 and the cover 200 may be screw-coupled together through a screw 290. The housing 100 and the cover 200 may include a first coupling portion 112 and a second coupling portion 230 to which the screw 290 is coupled, respectively. The first coupling portion 112 and the second coupling portion 230 may be disposed to face each other in an up and down direction, and each may include a hole into which the screw 290 is coupled.

The cover 200 may include an opening. In detail, a first opening through which fluid is sucked and a second opening through which circulated fluid is discharged may be formed on one surface of the cover 200. A third opening 212 connected to the first opening and a fourth opening 214 connected to the second opening may be formed on the other surface of the cover 200. The first opening and the second opening are formed on a lower surface of the cover 200, and the third opening 212 and the fourth opening 214 can be formed on an upper surface being coupled to the housing 100.

A mounting unit 210 being protruded upward and coupled to a space inside the can 470, which will be described later, may be disposed on an upper surface of the cover 200. Accordingly, the cover 200 may be understood as including a cover body and a mounting unit 210 being protruded from an upper surface of the cover body. The cross section of the mounting unit 210 may be circular.

The mounting unit 210 may be screw-coupled to a space inside the can 470. The cross-sectional shape of the mounting unit 210 may correspond to the cross-sectional shape of the space inside the can 470. A ring-shaped sealing member 220 for sealing may be disposed between the outer circumferential surface of the mounting unit 210 and the inner surface of the space inside the can 470. The sealing member 220 is made of a rubber material and can prevent fluid from leaking between the outer circumferential surface of the mounting unit 210 and the inner surface of the space inside the can 470. The outer surface of the mounting unit 210 may be more recessed than other regions, and a groove into which the sealing member 220 is coupled may be formed.

A third opening 212 through which fluid is sucked and a fourth opening 214 through which the sucked fluid is discharged may be formed on an upper surface of the cover 200. The fluid may be oil. Each of the third opening 212 and the fourth opening 214 may be formed to have an arc shape, and the gap may be provided to be gradually narrowed as it travels from one side to the other. More specifically, it may be disposed in a way that the side with a wide gap of the third opening 212 faces the side with a wide gap of the fourth opening 214, and the side with a narrow gap of the third opening 212 faces the side with a narrow gap of the fourth opening 214.

The third opening 212 and the fourth opening 214 may be formed on an upper surface of the mounting unit 210.

The housing 100 may be made of resin or plastic, but is not limited thereto.

The housing 100 may include an upper region 120 and a lower region 110. The upper region 120 may have a rectangular cross-section. The lower region 110 is disposed at a lower portion of the upper region 120 and may be formed to have a circular cross-section.

A second space 122 may be formed inside the upper region 120. The second space 122 may have a groove shape. A plurality of electronic parts for driving may be disposed in the second space 122. For example, a printed circuit board (not shown) and a terminal 395 may be disposed in the second space 122. Multiple devices may be mounted on the printed circuit board.

The housing 100 may include a first partition wall 101 (see FIG. 2) partitioning the upper region 120 and the lower region 110. A hole may be formed in the center of the first partition wall 101 into which a first protruded portion 478 of a can 470, which will be described later, is coupled.

A separate cover (not shown) may be coupled to an upper surface of the housing 100 to cover the second space 122. In this case, the separate cover is referred to as a second cover, and the cover 200 may be referred to as a first cover 200.

A stator 300 and a gear may be disposed in the housing 100. The gear may be coupled on the cover 200.

The stator 300 may be disposed inside the housing 100.

The stator 300 may be formed integrally with the housing 100 by double injection. The stator 300 and the housing 100 may be formed integrally through insert injection. The stator 300 may be molded inside the housing 100. A stator accommodation space in which the stator 300 is disposed may be formed inside the housing 100. The stator accommodation space may be disposed outside the first space 114. The outer surface of the stator 300 may be surrounded by the housing 100.

The stator 300 may include a stator core 320 and a coil 310 wound around the stator core 320. The stator 300 may include an insulator (not shown) being disposed to surround an outer surface of the core. The coil 310 may be wound on an outer surface of the insulator.

A router 390 may be disposed on an upper surface of the stator core 320, and the coil 310 being protruded upward from the stator core 320 may be aligned by the router 390.

A bus bar 340 may be disposed on an upper surface of the router 390, and an end of the coil 310 being protruded upward from the stator core 320 may be fused to the bus bar 340.

A terminal 395 may be disposed on an upper surface of the router 390, and the terminal 395 may have a shape that protrudes upward from the router 390. The printed circuit board may be electrically connected to the terminal 395.

The first space 114 may be formed in the center of the housing 100. The first space 114 may be formed inside the lower region 110. The first space 114 may have a groove shape in which a portion of the lower surface of the housing 100 is recessed upward. The arrangement region of the stator 300 and the first space 114 may be partitioned by a second partition wall (not shown). The inner surface of the second partition wall may form the inner surface of the first space 114. In other words, the second partition wall may be disposed between the stator 300 and an outer gear 410, which will be described later. The second partition wall may be formed to have a thickness of 0.2 mm to 1 mm.

The second space 122 and the first space 114 may be partitioned in an up and down direction by the first partition wall 101. The lower surface of the first partition wall 101 may form the upper surface of the first space 114. The first space 114 and the second space 122 may be partitioned into different regions through the first partition wall 101. Accordingly, the fluid in the first space 114 can be prevented from flowing into the second space 122.

The gear may be disposed inside the stator 300. The gear may include an outer gear 410 and an inner gear 450. The outer gear 410 and the inner gear 450 may be disposed in the first space 114.

The outer gear 410 may be disposed inside the stator 300. The second partition wall may be disposed between the outer gear 410 and the stator 300.

The outer gear 410 may include a core 411 and a magnet 412 being mounted on the core 411. The magnet 412 may be disposed on an outer circumferential surface of the core 411 to correspond to the coil 310. The outer gear 410 may be a surface permanent magnet (SPM) type in which the magnet 412 is attached to an outer circumferential surface of the core 411. For this purpose, a groove in which the magnet 412 is mounted may be formed on an outer circumferential surface of the core 411. The grooves may be provided in plural and disposed to be spaced apart from each other along the circumferential direction.

A magnet guide 414 being protruded outward may be formed on an outer circumferential surface of the core 411. The magnet guide 414 may be provided in plural numbers and disposed to be spaced apart from one another along the circumferential direction. A groove into which the magnets 412 are coupled may be formed between the plurality of magnet guides 414. The magnet guide 414 may support the side surface of the magnet 412.

The axial length of the magnet guide 414 may be smaller than the axial length of the magnet 412. The side surface of the magnet guide 414 facing the side surface of the magnet 412 may be formed with an inclined surface whose circumferential length becomes longer as it travels toward the outside. Additionally, an inclined surface corresponding to the inclined surface may be formed also on the side surface of the magnet 412 facing the side surface of the magnet guide 414.

When a current is applied to the coil 310 of the stator 300, the outer gear 410 may be rotated by electromagnetic interaction between the stator 300 and the outer gear 410.

A first hole in which the inner gear 450 is disposed may be formed in the center of the outer gear 410. A plurality of ridge portions being protruded inward from an inner circumferential surface and a plurality of valley portions being disposed between the plurality of ridge portions may be formed on an inner circumferential surface of the first hole. That is, a first gear in which a plurality of ridge portions and valley portions are alternately disposed may be formed on an inner circumferential surface of the first hole.

The inner gear 450 may be disposed inside the outer gear 410. The inner gear 450 may be disposed in the first hole. The outer gear 410 may be referred to as an external rotor, and the inner gear 450 may be referred to as an internal rotor.

The outer circumferential surface of the inner gear 450 may include a plurality of ridge portions 454 being protruded outward from the outer circumferential surface and a valley portion 458 disposed between the plurality of ridge portions 454. A second gear may be formed on the outer circumferential surface of the inner gear 450 in which a plurality of ridge portions 454 and a plurality of valley portions 458 are alternately arranged.

In the inner gear 450, a second lobe having N gear teeth may be disposed along the circumferential direction with respect to the center of rotation. In other words, the outer gear 410 may be provided with N+1 first lobes facing inward in the radial direction. The first lobe may be disposed to be caught by the second lobe. When the outer gear 410 rotates, the inner gear 450 may be rotated by the first lobe and the second lobe. As the inner gear 450 rotates, fluid may flow into the space inside a can 470, which will be described later, or fluid in the space inside the can 470 may be discharged to the outside.

The outer gear 410 and the inner gear 450 may rotate eccentrically. Due to the eccentricity of the outer gear 410 and the inner gear 450, a volume capable of transporting fluid fuel is generated between the outer gear 410 and the inner gear 450, so that the portion where the volume has increased sucks in the fluid due to the pressure drop, and the portion where the volume has decreased discharges the fluid due to the increase in pressure.

The inner gear 450 and the outer gear 410 may be disposed so that their centers do not coincide with each other. The center of rotation of the outer gear 410 and the inner gear 450 may be different.

A hole 452 to which a shaft 250, which will be described later, is coupled may be formed in the center of the inner gear 450.

The pump 10 may include a can 470. The can 470 may be disposed in the first space 114. The can 470 may be made of a metal material. The can 470 may be formed integrally with the housing 100 by double injection. However, this is an example, and the can 470 may also be made of plastic material.

The can 470 may comprise: a body portion 472; a lower end portion 474 being protruded outward from a lower end of the body portion 472; and a first protruded portion 478 being protruded upward from an upper surface of the body portion 472.

A space may be formed inside the body portion 472. The inner gear 450 and the outer gear 410 may be disposed in the space. The cross-sectional shape of the body portion 472 may be formed to correspond to the cross-sectional shape of the first space 114. For example, the cross-sectional shape of the body portion 472 may be circular.

The lower end portion 474 may be formed to be bent and extended outward from the lower end of the body portion 472. The lower end portion 474 may be disposed between a lower surface of the housing 100 and an upper surface of the cover 200.

The first protruded portion 478 may be coupled to a hole in the first partition wall 101. The cross-sectional shape of the first protruded portion 478 may be formed to correspond to the cross-sectional shape of the hole. The upper end of the first protruded portion 478 may be protruded upward from an upper surface of the first partition wall 101.

A bearing space may be formed inside the first protruded portion 478 to accommodate a bearing 490, which will be described later. The first protruded portion 478 may have a smaller cross-sectional area than the body portion 472.

The can 470 may prevent fluid in the first space 114 from flowing into the second space 122.

The pump 10 may include a support 430. The support 430 is coupled to the outer gear 410 and can support the outer gear 410 inside the first space 114. The support 430 has a circular cross-sectional shape and may be coupled to an upper portion of the outer gear 410. The support 430 may be coupled to the outer gear 410 by press fitting.

The support 430 may include a base 432 being disposed on one side surface of the outer gear 410. As an example, the base 432 may be coupled to an upper surface of the outer gear 410. The cross-sectional area of the base 432 may be smaller than the cross-sectional area of the outer gear 410. A hole through which a shaft 250, which will be described later, penetrates may be formed in the center of the base 432.

The support 430 may include a coupling portion 434 being protruded downward from the edge region of the base 432 and coupled to the side surface of the outer gear 410. The coupling portion 434 may be disposed between an outer surface of the core 411 and an inner surface of the magnet 412. The inner surface of the coupling portion 434 may face an outer surface of the core 411, and the outer surface of the coupling portion 434 may face an inner surface of the magnet 412. The lower end of the coupling portion 434 may be in contact with an upper surface of the magnet guide 414. The coupling portion 434 may be press-fitted between an outer surface of the core 411 and an inner surface of the magnet 412.

In detail, the support 430 may be disposed between the magnet 412 and the core 411. To this end, the core 411 may include a lower region where the magnet guide 414 is disposed on an outer circumferential surface, and an upper region being disposed above a lower region and where the support 430 is coupled to an outer circumferential surface. The cross-sectional area of the upper region may be smaller than that of the lower region. The cross-sectional area of the space inside the support 430 may correspond to the cross-sectional area of the upper region.

When the support 430 is coupled to an outer circumferential surface of the upper region, it may be disposed in a way that the inner surface of the support 430 faces the outer surface of the upper region, and the outer surface of the support 430 may faces the inner surface of the magnet 412. An adhesive region may be formed between an inner surface of the support 430 and an outer surface of the upper region, and between the outer surface of the support 430 and an inner surface of the magnet 412. The lower end of the support 430 may be in contact with an upper surface of the lower region.

The support 430 may include a second protruded portion 436 being protruded upward from an upper surface. The second protruded portion 436 may be protruded from an upper surface of the base 432 in a direction opposite to the protruding direction of the coupling portion 434. That is, the second protruded portion 436 may be protruded upward from an upper surface of the base 432. The second protruded portion 436 has a smaller cross-sectional area than the base 432 and may have a circular cross-sectional shape. The second protruded portion 436 may be disposed in a bearing space inside the first protruded portion 478 of the can 470. The second protruded portion 436 may be disposed to be overlapped with the first partition wall 101 in a horizontal direction. The second protruded portion 436 has a ring-shaped cross section formed with a space inside, and the bearing 490 may be disposed in an inner space of the second protruded portion 436.

The support 430 may be disposed to form the same center of rotation as the outer gear 410.

The pump 10 may include a bearing 490. The bearing 490 may be disposed in the bearing space. The bearing 490 may be a ball bearing. Accordingly, the bearing 490 may include balls being disposed between an outer ring and an inner ring. A coupling hole 495 (see FIG. 3) may be formed in the center of the bearing 490. A shaft 250, which will be described later, may be coupled to the coupling hole 495. The shaft 250 may be press-fitted into the coupling hole 495. The upper shaft 250 may be coupled to the inner ring. The outer surface of the shaft 250 may be in contact with an inner surface of the inner ring. Therefore, when the support 430 rotates together with the outer gear 410, the bearing 490 can support the rotation of the shaft 250. The support 170 may rotate integrally with the bearing 490 and the outer gear 410.

Meanwhile, an upper surface of the second protruded portion 436 and an upper surface of the bearing 490 may be spaced apart from a lower surface of the first protruded portion 478.

The pump 10 may include a shaft 250. The shaft 250 may support rotation of the inner gear 450 or the outer gear 410. The shaft 250 may have a shape being protruded upward from an upper surface of the cover 200. The shaft 250 may have a shape being protruded upward from an upper surface of the mounting unit 210. The shaft 250 may be formed as one body with the cover 200.

The shaft 250 may include a first region 252 being coupled to the inner gear 450 and a second region 254 being coupled to the bearing 490. The first region 252 may be coupled to the hole 452 of the inner gear 450, and the second region 254 may be coupled to the coupling hole 495 of the bearing 490.

The first region 252 may have a shape being protruded upward from an upper surface of the cover 200. The first region 252 may have a first diameter. The first region 252 may have a first length L1 (see FIG. 6) with respect to the axial direction.

The second region 254 may have a shape being protruded upward from an upper surface of the first region 252. The second region 254 may have a second diameter smaller than the first diameter. With respect to the axial direction, the second region 254 may have a second length L2 that is smaller than the first length L1. Here, the second length L2 may be ½ or less than of the first length L1. The cross-sectional area of the first region 252 may correspond to the cross-sectional area of the hole 452. The cross-sectional area of the second region 254 may correspond to the cross-sectional area of the coupling hole 495.

The axial length of the first area 252 may correspond to the axial length of the inner gear 450 or the outer gear 410.

Each of the first region 252 and the second region 254 may have a circular cross-section. The first region 252 and the second region 254 may have different centers. The center O1 of the first region 252 may be different from the center O2 of the second region 254. The first region 252 and the second region 254 may be disposed eccentrically. With respect to the radial direction of the shaft 250, the distance between the center of the first region 252 and the center of the second region 254 may be 0.02 mm or less.

The center O1 of the first region 252 may correspond to the center of rotation of the inner gear 450. The center O2 of the second region 254 may correspond to the center of rotation of the outer gear 410. Accordingly, the rotation of the bearing 490 and the outer gear 410 is supported about the second region 254, and the rotation of the inner gear 450 may be supported about the first region 252.

According to the above structure, the eccentricity between the outer gear and the inner gear can be set through the eccentricity of the first and second regions, so there is an advantage in that the precision of assembly between a plurality of parts can be improved.

In addition, since rotation components including bearings can be aligned through a single shaft, there is an advantage in that the overall size of the product can be reduced with respect to an axial direction.

In addition, since the inner gear, outer gear, and shaft are coupled to one another simply by assembling the shaft and the inner gear, and the shaft and the outer gear, there is an advantage in that production efficiency can be enhanced by reducing the number of assembly man-hours.

In the above description, it is described that all the components constituting the embodiments of the present invention are combined or operated in one, but the present invention is not necessarily limited to these embodiments. In other words, within the scope of the present invention, all of the components may be selectively operated in combination with one or more. In addition, the terms "comprise", "include" or "having" described above mean that the corresponding component may be inherent unless specifically stated otherwise, and thus it should be construed that it does not exclude other components, but further include other components instead. All terms, including technical and scientific terms, have the same meaning as commonly understood by one of ordinary skill in the art unless otherwise defined. Terms used generally, such as terms defined in a dictionary, should be interpreted to coincide with the contextual meaning of the related art, and shall not be interpreted in an ideal or excessively formal sense unless explicitly defined in the present invention.

The above description is merely illustrative of the technical idea of the present invention, and those skilled in the art to which the present invention pertains may make various modifications and changes without departing from the essential characteristics of the present invention. Therefore, the embodiments disclosed in the present invention are not intended to limit the technical idea of the present invention but to describe the present invention, and the scope of the technical idea of the present invention is not limited by these embodiments. The protection scope of the present invention should be interpreted by the following claims, and all technical ideas within the equivalent scope should be interpreted as being included in the scope of the present invention.

The invention claimed is:

1. A pump comprising:
a housing;
a stator disposed inside the housing;
an outer gear disposed inside the stator;
an inner gear disposed inside the outer gear;
a shaft disposed at the center of the inner gear;
a support disposed on the outer gear; and
a bearing coupled to one end of the shaft,
wherein the shaft comprises a first region coupled to the inner gear and a second region coupled to the bearing,
wherein the center of the first region and the center of the second region are different from each other, and
wherein the support includes:
a base disposed on one surface of the outer gear;
a coupling portion protruding from one surface of the base and coupled to the outer surface of the outer gear; and
a second protrusion protrudes from an other surface of the base and is arranged to surround an outer surface of the bearing.

2. The pump according to claim 1, wherein the cross-sectional area of the first region is larger than the cross-sectional area of the second region.

3. The pump according to claim 1, wherein the outer gear and the inner gear rotates eccentrically.

4. The pump according to claim 1, wherein an axial length of the first region may correspond to an axial length of the inner gear and the outer gear.

5. The pump according to claim 1, wherein with respect to an axial direction, a length of the second region is smaller than a length of the first region.

6. The pump according to claim 5, wherein the length of the second region is ½ or less than the length of the first region.

7. The pump according to claim 1, wherein a center of the first region corresponds to a center of rotation of the inner gear.

8. The pump according to claim 1, wherein a center of the second region corresponds to a center of rotation of the outer gear.

9. The pump according to claim 1, wherein a distance between a center of the first region and a center of the second region with respect to a radial direction is 0.02 mm or less.

10. The pump according to claim 1, wherein the inner gear includes a first hole to which the first region is coupled, and wherein the bearing includes a second hole to which the second region is coupled.

11. The pump according to claim 1, comprising a can disposed within the stator and having a space formed on an inside where the outer gear and the inner gear are coupled.

12. The pump according to claim 1, comprising a cover coupled to a bottom of the housing, wherein the shaft protrudes upward from an upper surface of the cover.

13. The pump according to claim 12, wherein the cover and the shaft are formed as one body.

14. The pump according to claim 1, wherein the outer gear includes a core and a magnet disposed on an outer surface of the core, and wherein the coupling portion is disposed between the outer surface of the core and the inner surface of the magnet.

15. The pump according to claim 1, wherein the base includes a hole through which the shaft passes.

16. A pump comprising:

a housing;

a stator disposed inside the housing;

an outer gear disposed inside the stator;

an inner gear disposed inside the outer gear;

a can disposed within the stator and having a space formed on an inside where the outer gear and the inner gear are coupled;

a shaft disposed at the center of the inner gear; and a bearing coupled to one end of the shaft, wherein the shaft comprises a first region coupled to the inner gear and a second region coupled to the bearing, wherein a center of the first region is a rotation center of the inner gear wherein a center of the second region is a rotation center of the outer gear, wherein the can includes a body portion inside which the outer gear is disposed, and a first protrusion protruding upward from an upper surface of the body portion, and wherein the bearing is disposed in a space within the first protrusion.

17. A pump comprising:

a housing;

a stator disposed inside the housing;

an outer gear disposed inside the stator;

an inner gear disposed inside the outer gear;

a shaft disposed at the center of the inner gear;

a support disposed on the outer gear; and a bearing coupled to one end of the shaft, wherein the shaft comprises a first region coupled to the inner gear and a second region coupled to the bearing, wherein a center of the first region is a rotation center of the inner gear, wherein a center of the second region is a rotation center of the outer gear, and wherein the support includes:

a base disposed on one surface of the outer gear;

a coupling portion protruding from one surface of the base and coupled to the outer surface of the outer gear; and a second protrusion protrudes from an other surface of the base and is arranged to surround an outer surface of the bearing.

18. The pump according to claim 17, wherein the inner gear and the outer gear rotate eccentrically with each other.

19. The pump according to claim 17, wherein a cross-sectional area of the first region is larger than a cross-sectional area of the second region.

* * * * *